United States Patent [19]

McIntosh et al.

[11] Patent Number: 4,859,200

[45] Date of Patent: Aug. 22, 1989

[54] DOWNHOLE ELECTRICAL CONNECTOR FOR SUBMERSIBLE PUMP

[75] Inventors: Ronald M. McIntosh, Wagoner; Richard T. Rentzel, Claremore; Robert W. Stewart, Disney; Daniel L. Daugherty, Tulsa, all of Okla.

[73] Assignee: Baker Hughes Incorporated, Houston, Tex.

[21] Appl. No.: 280,067

[22] Filed: Dec. 5, 1988

[51] Int. Cl.[4] ..... H01R 13/52

[52] U.S. Cl. ..... 439/275; 439/271; 439/587; 439/604

[58] Field of Search ..... 439/274–277, 439/587–589, 604, 606, 461–464, 271

[56] References Cited

U.S. PATENT DOCUMENTS

| | | | |
|---|---|---|---|
| 4,614,392 | 9/1986 | Moore | 439/587 |
| 4,693,534 | 9/1987 | Clark | 439/275 |
| 4,728,296 | 3/1988 | Stamm | 439/277 |

*Primary Examiner*—P. Austin Bradley

*Attorney, Agent, or Firm*—James E. Bradley

[57] ABSTRACT

A pothead for connecting electrical cable to a downhole submersible pump motor utilizes primary and secondary seals. The pothead includes a rigid plastic insert that is forced into the shell. The insert has passageways extending through it for the conductors of the electrical cable. An elastomeric compression sleeve is located in each passageway and encircles each conductor. A locking ring is secured in the passageway and bears against the compression sleeve to cause the compression sleeve to seal around the conductor. The interior of the shell is filled with an elastomeric material as a secondary seal.

3 Claims, 2 Drawing Sheets

35
21
23
19
17
18
15
23a
25
23b
39
37
13
11
27
29
31
33

40
39
41

DOWNHOLE ELECTRICAL CONNECTOR FOR SUBMERSIBLE PUMP

BACKGROUND OF THE INVENTION

1. Field of the Invention:

This invention relates in general to pumps having electrical submersible motors, and in particular to a device for connecting the electrical cable to the head of the motor.

2. Description of the Prior Art:

Electrical submersible pumps for oilfield applications have large three phase electrical motors submersed within the well and located above a centrifugal pump. A power cable extends down through the well. A connection known as a pothead connects the three connectors of the electrical cable to the upper end of the motor.

A common type of pothead has a rigid metal shell through which the electrical conductors extend. Each conductor is insulated and has a terminal on its outer end for insertion into a receptacle in the motor. An elastomeric material is injected around the insulated conductors to serve as a primary seal. While successful, obtaining good bonding between the elastomeric material and the conductors is sometimes difficult.

Improvements are desirable, particularly in providing better sealing around the conductors.

SUMMARY OF THE INVENTION

The pothead of this invention utilizes a rigid, plastic insert located at the outer end of the shell. The insert has a passageway through it for each of the electrical conductors. An elastomeric deformable, compression sleeve is located in each passageway. A hard plastic locking ring is secured in each passageway and bears against the compression sleeve. When pressed in, the locking ring deforms the compression sleeve to provide a primary seal around the insulated conductor. As a secondary seal, the interior of the shell is filled with an elastomeric material.

DESCRIPTION OF THE PREFERRED EMBODIMENT

Figures 1, 3:
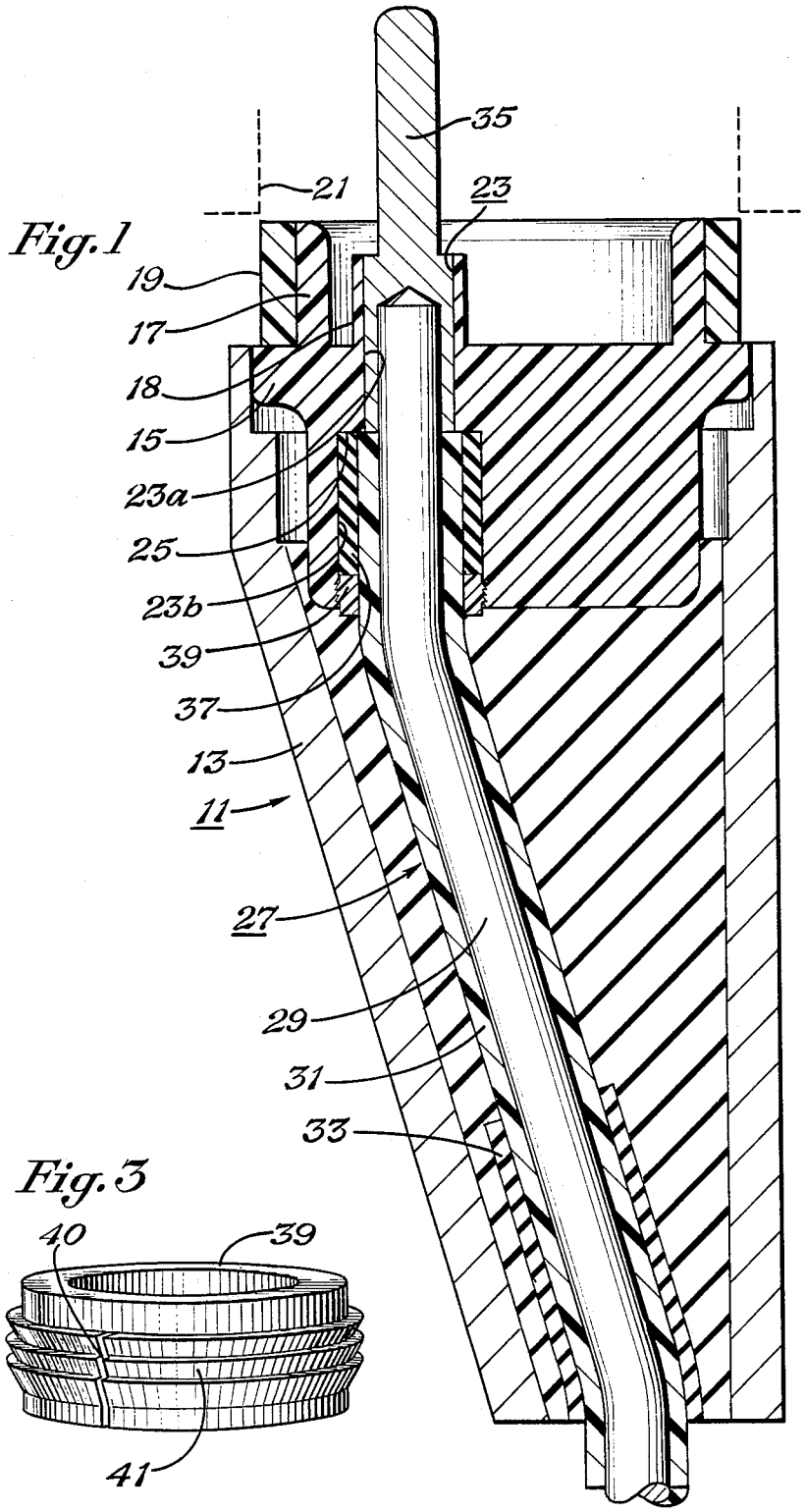
FIG. 1 is a sectional view illustrating a pothead constructed in accordance with this invention, and showing one of the three electrical conductors.
FIG. 3 is a side view of a locking ring used with the pothead of FIG. 1.

Referring to FIG. 1, pothead 11 has a rigid metal shell 13. Shell 13 has means for securing to an electrical motor (not shown) for use in downhole submersible pump applications. An insert 15 is pressed into one end of the shell 13 with an interference fit.

Insert 15 is of a hard plastic material, and therefore is substantially rigid. It may be of Nylon or a similar material such as Torlon. Insert 15 has on its outer end an integral cylindrical nose 17. Three circular lips 18 (only one shown) protrude integrally from the outer end of insert 15. The lips 18 are spaced apart from each other 180 degrees and encircled by the nose 17. A separate seal ring 19 encircles the nose 17. The nose 17 is adapted to extend into the opening 21 of an electrical motor (not shown).

Pothead 11 has three passageways 23 extending through it, but only one is shown. Each passageway 23 includes an outer portion **23*a* which extends through one of the lips 18. A larger diameter passageway inner portion 23*b* extends from the inner end of the insert 15. The junction of the passageway portions 23*a* and 23*b* results in an inward facing shoulder 25**.

Three electrical conductors 27 (only one shown) extend through the shell 13, each extending into one of the passageways 23. Each electrical conductor 27 includes an electrical wire 29. Wire 29 is enclosed by an insulating layer 31 of an EPDM (ethylene-propylenediene monomer terpolymer) plastic material. The insulating layer 31 is surrounded by a rubber jacket 33. U.S. Pat. No. 4,658,089 issued Apr. 14, 1987, Raymond L. Guzy, describes more details of a suitable insulating layer 31 and jacket 33. During installation, jacket 33 is stripped from the insulating layer 31 a selected distance inward from the insert 15. The insulating layer 31 extends completely to the shoulder 25. An electrical terminal such as pin 35 is soldered or crimped to the outer end of wire 29. The inner end of the terminal 35 is located at the shoulder 25.

A compression sleeve 37 is located in the passageway inner portion **23*b*. Compression sleeve 37 is of a soft elastomeric material. Compression sleeve 37 has an inner diameter substantially that of the insulating layer 31. The outer diameter of the compression sleeve 37 is substantially the same as the inner diameter of the passageway inner portion 23*b*. Compression sleeve 37** is a cylindrical tube.

Figure 2:
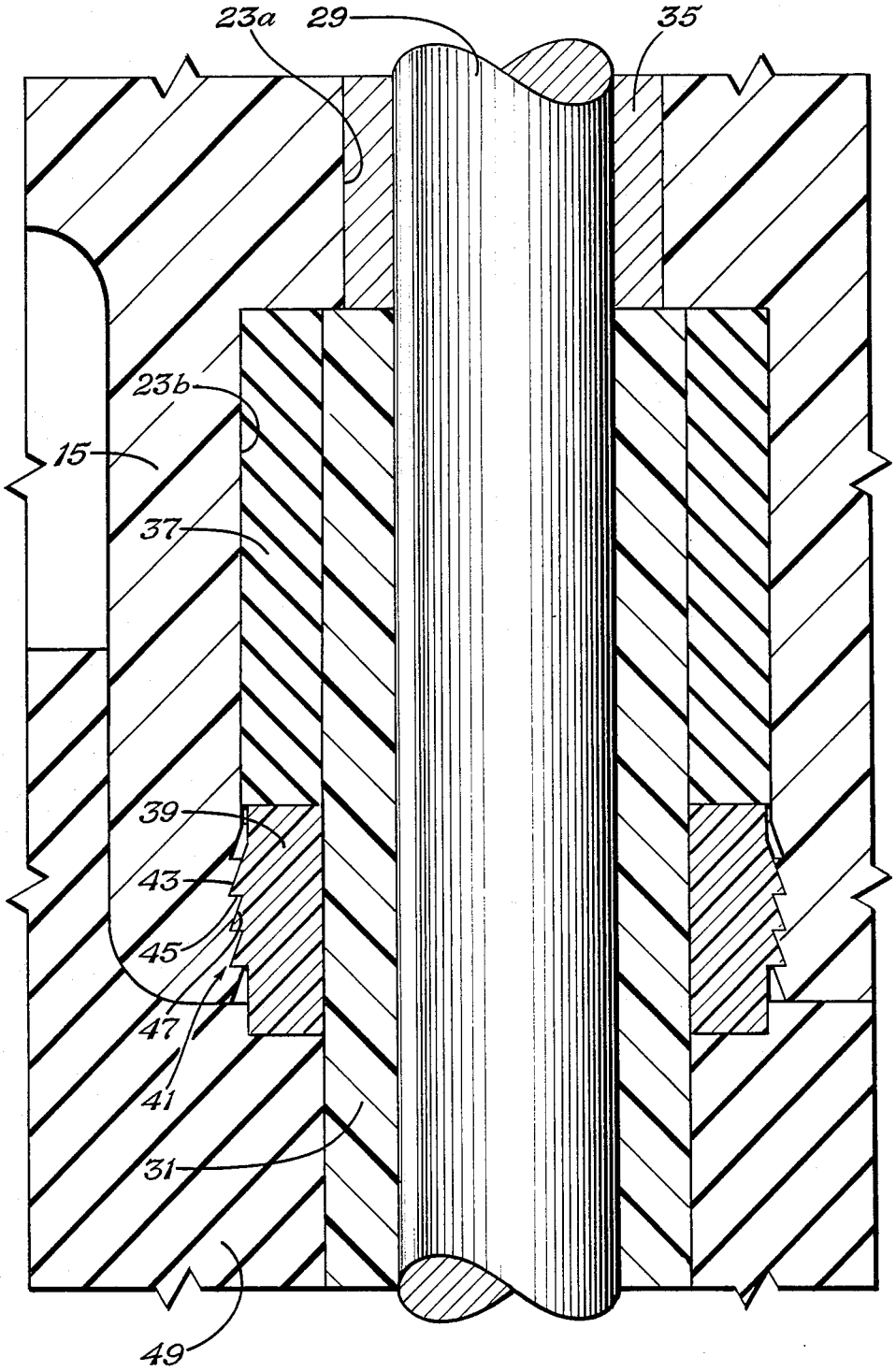
FIG. 2 is an enlarged sectional view of a portion of the pothead of FIG. 1.

A compression ring 39 is used to secure the compression sleeve 37 in place and to deform it for sealing the insulating layer 31 to the passageway inner portion **23*b*. Referring to FIGS. 2 and 3, the compression ring 39 is a plastic member that has a hardness substantially greater than the hardness of the compression sleeve 37. The compression ring 39 has three slots 40, of which one is shown in FIG. 3. The slots 40 extend from the outer end about three-fourths the thickness of the compression ring 39. The slots 40 are parallel to the axis of the ring 39 and spaced 120 degrees from each other. The slots 40 allow the outer end of the ring 39 to compress as it is pressed into the passageway inner portion 23*b* in contact with the compression sleeve 37**.

Compression ring 39 has a plurality of circumferential grooves 41. Each groove 41 is parallel to the other grooves 41 and is located in a plane that is perpendicular to the axis of the compression ring 39. Each groove 41 has a saw-toothed configuration in section. Each groove 41 has an inclined flank 43 that intersects the axis of the compression ring 39 at an acute angle. Each inclined flank 43 is joined by a shoulder 45 that is located in a plane perpendicular to the axis of the compression ring 39. Shoulders 45 are on the inward ends of the flanks 43.

The compression ring grooves 41 are adapted to engage mating grooves 47 of the same configuration formed in the inner end of the passageway inner portion **23*b*. The compression ring 39 has an outer diameter in its free state measured at the apex of each groove 41 that is slightly greater than the inner diameter of the passageway grooves 47 measured at the base of each groove 47. The free state exists prior to insertion of the compression ring 39 into the passageway inner portion 23*b***. This creates an interference fit.

The interior of the shell 13 is filled with an elastomeric material 49 that is injected after the conductors 27 are positioned in place and secured by the compression rings 41.

To assemble the pothead 11, the jacket 33 is stripped back a selected distance from the insulating layer 31 The terminal 35 is secured to the end of the wire 29. The compression sleeve 37 and compression ring 39 are slipped over the insulating layer 31. The electrical conductors 27 are each inserted into one of the passageways 23. When fully inserted, the end of the insulating layer 31 will contact the shoulder 25 in the insert 15.

The compression sleeve 37 is pushed into contact with the shoulder 25. The compression ring 39 is then forced into the passageway inner portion **23*b*. The pressure on the compression ring 39 is monitored as the compression ring 39 is forced into place. The grooves 41 will ratchet past the grooves 47. When the desired pressure has been reached, further force on the compression ring 39** is removed.

The engagement of the grooves 41 with the grooves 47 prevents the compression ring 39 from releasing from the insert 15. Due to differences in tolerances, it is possible for the desired pressure to be reached when only one of two of the grooves 41 engage the grooves 47. The compression ring 39 is not rotated as it is forced into the passageway inner portion **23*b*. The force of the compression ring 39 against the compression sleeve 37 deforms the compression sleeve 37. It will fit tightly in the space between the conductor insulating layer 31 and the walls of the passageway inner portion 23*b*. This provides a primary seal to prevent any well bore fluid from passing from the interior of the shell 13 into contact with the terminal 35**.

Then, liquid elastomeric material 49 is injected into the shell 13 to completely fill the interior. The elastomeric material 49 will cure and bond to the insulating layer 31 to form a secondary seal. The seal ring 19 is placed on the nose 17 of the pothead 11, and the pothead 11 is then suitable for connection to a motor.

The invention has significant advantages. The primary seal is accomplished by a mechanical means wherein the pressure can be monitored to insure a tight seal. The elastomeric material serves as a secondary seal. Bonding of the injected elastomeric material about the conductor is not so critical as in the prior art pothead because the elastomeric material is secondary.

While the invention has been shown in only two of its forms, it should be apparent to those skilled in the art that it is not so limited, but is susceptible to various changes without departing from the scope of the invention.

We claim:

1. A device for attaching an end of an electric cable to the head of a motor, the electric cable having at least one conductor with a terminal on its end, the device comprising in combination:

a rigid shell;

an insert secured in one end of the shell, the insert having one end located in the shell and another end protruding from the shell for insertion into an opening in the head of the motor;

at least one passageway in the insert through which the conductor extends with the terminal protruding from the insert;

an elastomeric compression sleeve located in the passageway and encircling the conductor;

a locking ring secured in the passageway and bearing against the compression sleeve to cause the compression sleeve to seal around the conductor; and the interior of the shell being filled with an elastomeric material.

2. A device for attaching an end of an electric cable to the head of a motor, the electric cable having at least one conductor with a terminal on its end, the device comprising in combination:

a rigid shell;

an insert secured in one end of the shell, the insert having an inner end located in the shell and an outer end protruding from the shell for insertion into an opening in the head of the motor;

at least one passageway in the insert through which the conductor extends with the terminal protruding from the outer end of the insert, the insert having an inner portion on the inner end of the insert that is of larger diameter than an outer portion on the outer end of the insert;

an elastomeric compression sleeve located in the inner portion of the passageway and encircling the conductor;

a split locking ring having a free state diameter greater than the diameter of the inner portion of the passageway, the locking ring being forced into the inner portion of the passageway and bearing against an inner end of the compression sleeve to deform the compression sleeve and cause the compression sleeve to seal around the conductor; and the interior of the shell being filled with an elastomeric material.

3. A device for attaching an end of an electric cable to the head of a motor, the electric cable having at least one conductor encased within an insulating layer and having a terminal on its end, the device comprising in combination:

a rigid shell;

a substantially rigid insert secured in one end of the shell, the insert having an inner end located in the shell and an outer end protruding from the shell for insertion into an opening in the head of the motor;

at least one passageway in the insert through which the conductor extends with the terminal protruding from the outer end of the insert, the passageway having an inner portion on the inner end of the insert that is of larger diameter than an outer portion of the passageway on the outer end of the insert, defining an inward facing shoulder;

the inner portion of the passageway having a plurality of circumferential, parallel grooves;

an elastomeric compression sleeve located in the inner portion of the passageway, outward of the grooves and encircling the conductor; and a split locking ring having a plurality of circumferential parallel grooves on its exterior, the locking ring being forced into the inner portion of the passageway and bearing against an inner end of the compression sleeve to force the compression sleeve against the inward facing shoulder and cause the compression sleeve to seal around the insulating layer of the conductor, the grooves of the locking ring engaging the grooves of the passageway to retain the locking ring in the passageway.

* * * * *